United States Patent [19]

Davis

[11] 3,939,529

[45] Feb. 24, 1976

[54] WINDOW OR THE LIKE STAYS

[75] Inventor: Ronald Percival Davis, Wellington, New Zealand

[73] Assignee: Interlock Industries Limited, Wellington, New Zealand

[22] Filed: Mar. 14, 1974

[21] Appl. No.: 451,197

[30] Foreign Application Priority Data

Mar. 16, 1973 New Zealand ..... 170109

[52] U.S. Cl. ..... 16/179; 16/129

[51] Int. Cl.[2] ..... E05D 15/58; E05D 7/04

[58] Field of Search ..... 16/140, 129, 179, 128 R, 16/136, 175

[56] References Cited

UNITED STATES PATENTS

| | | | |
|---|---|---|---|
| 2,425,905 | 8/1947 | Violante | 16/129 |
| 2,712,670 | 7/1955 | Lipking | 16/129 |
| 3,685,093 | 8/1972 | Sandersa et al. | 16/179 |

*Primary Examiner*—Patrick D. Lawson

*Attorney, Agent, or Firm*—Young & Thompson

[57] ABSTRACT

A window stay for swingably mounting a window sash on a window frame, comprises a pair of vertically superposed stub mounting plates secured to one of the sash and frame, and at least one further mounting plate secured to the other of the sash and frame. A pair of arms pivotally interconnect each stub mounting plate with the further mounting plate or plates. One of the pivotal connections of the arms is a friction joint of special form.

7 Claims, 4 Drawing Figures

WINDOW OR THE LIKE STAYS

This invention relates to improvements in stays designed for use in the adjustable mounting of windows or the like.

It is already known to provide a window stay having a window frame mounting plate, two arms of different length each pivoted at one end to the window frame mounting plate and a window sash mounting plate pivoted to the other ends of the two arms, each pivot being a wear-resistant friction type joint.

Such a window stay has been employed upon a type of window known as the "one inch domestic steel window". The window type has been used extensively in many overseas countries. This window has a cavity dimension between sash and frame elements of only ⅞ × 15/32 inch. The shallow front-to-back dimension of ⅞ inch provides very little depth for an upper arm of the window stay as mentioned above to close to a critical forward-leaning angle. Accordingly it has been necessary to incorporate a very short upper arm in the earlier stay which in turn seriously limited the room over the top of the sash for cleaning purposes.

It has been found in the past that if a longer upper arm is used, it requires a greater degree of compressive strength in the lower arm than has been available with the normal ⅛ inch thick lower arm used to date. There has been no room available within the 15/32 inch width dimension of the cavity for a greater lower arm thickness than ⅛ inch because the ⅛ inch required for both the sash mounting plate and the frame mounting plate of the earlier stay.

It has therefore been necessary to manufacture such stays to an extremely fine degree of accuracy; no facility for adjustment of "pull-in" at the top of the sash has been possible with the result that the stays have not been particularly easy to fit. It has not been possible for the window manufacturer to reduce the sash cover to provide a ½ inch wide cavity and consequently no room has been available in the cavity to provide thicker arms as required for longer stays for very large sashes.

The present invention is concerned with a stay of an improved construction.

Generally the invention consists of a window stay having two window-frame, or window-sash, mounting plates each plate being of stub form and pivoted to one end of an arm the other end of which is pivoted to a single window-frame, or window-sash, mounting plate, and at least one of the pivots being a wear-resistant friction type joint.

In further describing the invention, by way of example, reference will be made hereinafter to the accompanying drawing, in which.

Figure 1:
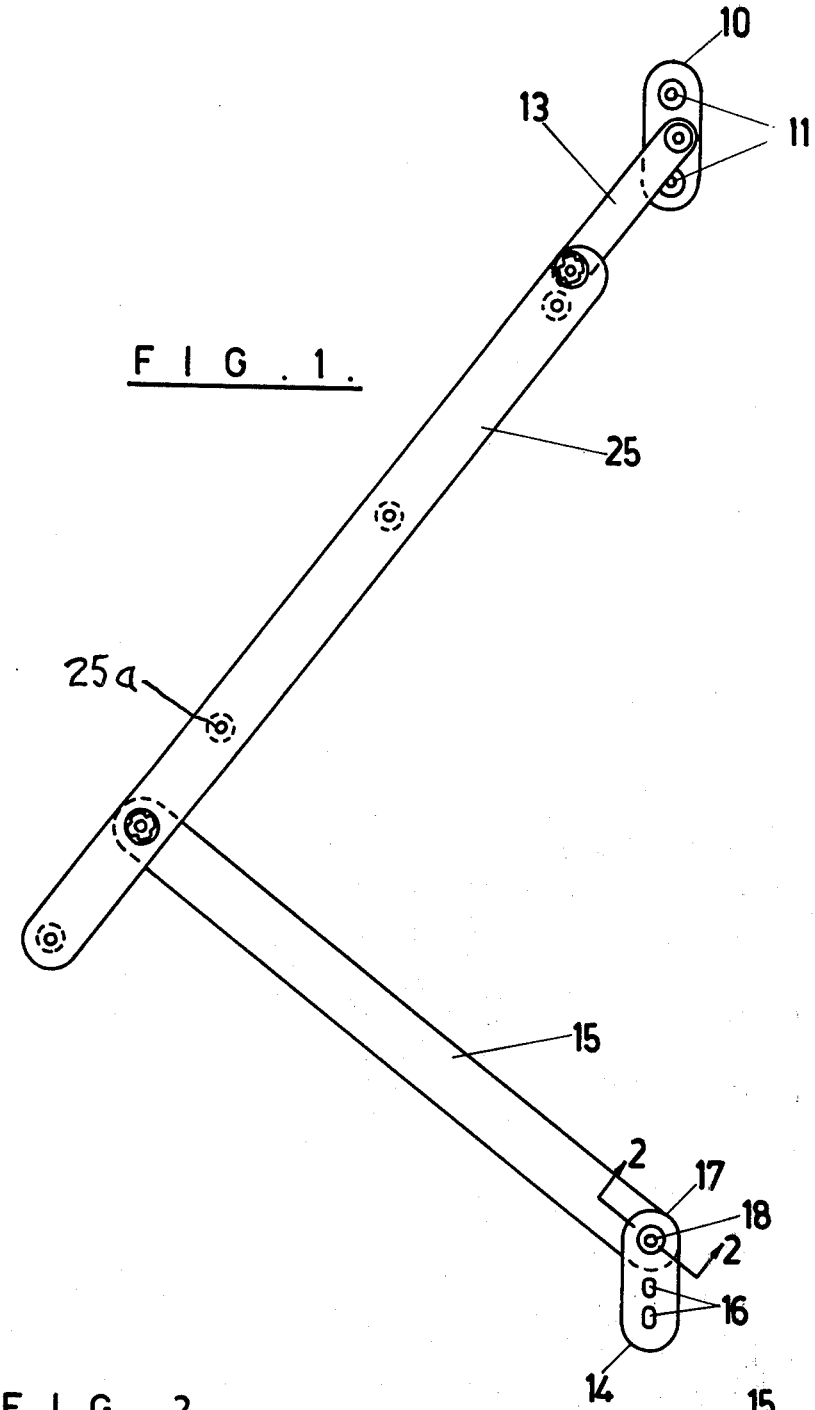
FIG. 1 is a side view of the stay.
Figure 2:
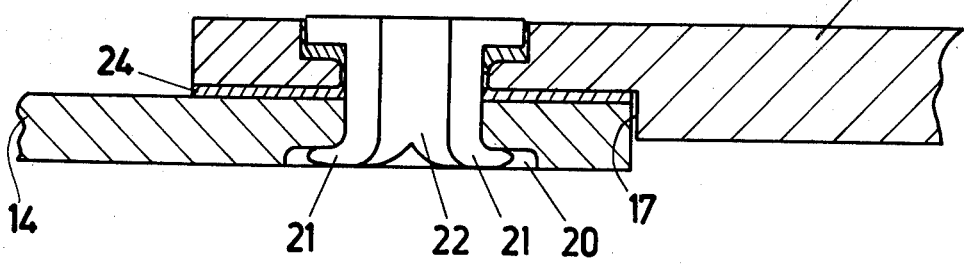
FIG. 2 is an enlarged cross-section taken on the line 2—2 in FIG. 1, FIGS. 3 and 4 are side views of alternative forms of the stay.

In further describing the invention, as a preferred embodiment, each window-frame mounting plate is of relatively short length, such as about 2 inches, but of course this is dependent upon size of stay. The upper plate 10 has a number of holes 11 positioned along its length for the reception of fastening rivets, screws etc by which it will be attached to a window frame (not shown). There can be two of these holes 11, one positioned at each side of the plate's pivot 12 to an upper one 13 of the two arms.

The other window-frame mounting plate 14 is pivoted to a lower arm 15 at an upper end of such plate. This other plate 14 has at one or more slots 16 suitably positioned at points along its length for the reception of fastening rivets, screws, etc. by which it can be adjustably attached to the window frame. The or each slot 16 extends centrally in line with the plate length.

The lower arm 15 may be thicker than that of the upper arm 13 and has a portion 17 milled away about its pivot 18 to the lower window-frame mounting plate 14. This milled-out portion 17 is such as to take the thickness of the lower plate 14 and also to allow the arm 15 to turn about its pivot 18 with such plate. Suitably it is desired to have a lower arm 15 of about twice the thickness of the plate 14. The milled-out portion 17 has a radiused end so as to take a similarly radiused end of the plate 14. In a modification (not shown) a relevant portion of the plate can be milled away, or even parts of the arm and the plate respectively.

The wear-resistant friction type pivot joints are as disclosed and claimed in my U.S. Pat. No. 3,497,909. Around its pivot hole each mounting plate 10 or 14 has a dimple raised by pressed metal displacement the metal of the plate being actually semi-sheared. This provides a countersink 20 below for a tail 21 of the pivot rivet 22 and a raised surface above for clearance of the arm 13 or 15. A special washer 24 of a self-lubricating plastics material such as Nylon is provided, which washer is formed in its cross-section with an annular recessed area to suit the raised dimple about the pivot hole. This washer 24 is inserted between the plate 10 or 14 and arm 13 or 15 so as to prevent metal to metal contact when under the pressure applied by the riveting.

When a pair of the stays is employed to mount a window sash to a window frame by reason of the window sash mounting plates 25 pivoted to the respective ends of the two short separate window-frame mounting plates 10 and 14 and having openings **25*a* therethrough for securement to the sash, a considerable portion of the plate as in my original stay has been eliminated, thus providing more room for the thicker lower arm 15. This also permits the incorporation of a relatively longer upper arm 13** therefore providing room over the window sash for cleaning.

By reason of the provision of the adjusting slot or slots 16 for the reception of window-frame fixing screws in the lower frame mounting plate 14, this permits the slight raising or lowering of such plate. This provides for adjustment of the degree of "pull-in" at the top of the window sash; and this is desirable to compensate for slight inaccuracies in the manufacture of either the window or the stays, or to provide for the varying requirements of different markets and weather conditions.

By the milled portion 17 of the lower arm 15 and insetting the end of the associated mounting plate 14, this reduces their combined thickness.

By the press displacement of the raised dimple around the pivot bearing holes, this provides the installation of the special Nylon bearing washer 24 to eliminate possibility of metal contact between arm and plate at this locality.

Figure 3:
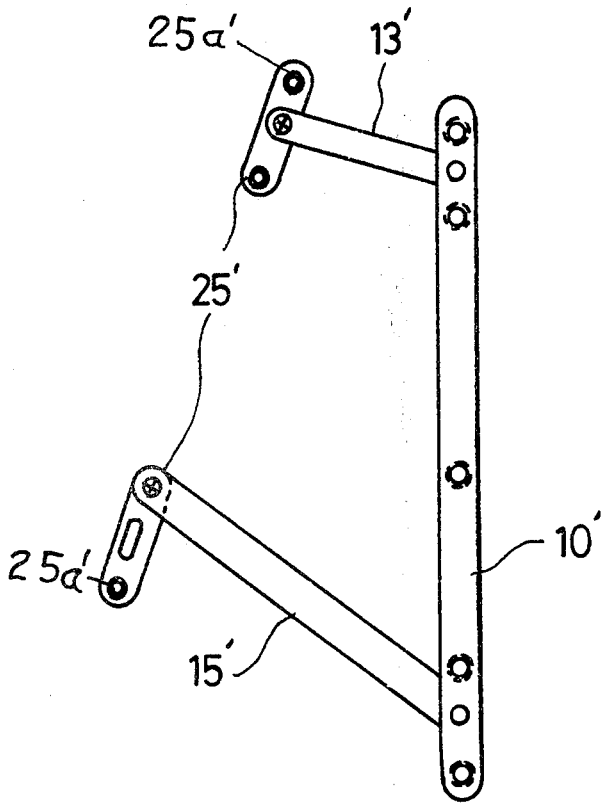
Figure 4:
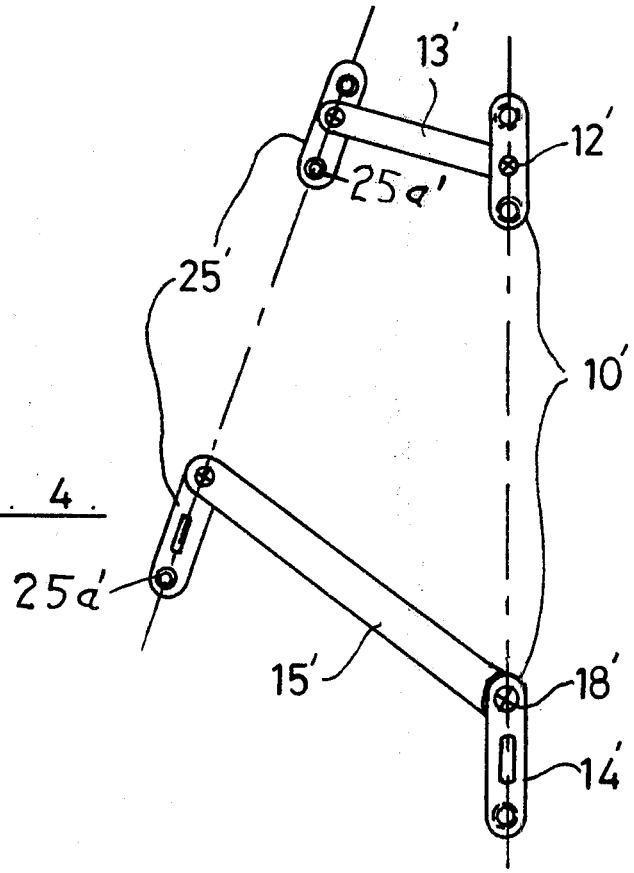

As previously indicated the above-mentioned features can be alternatively incorporated in the window-sash mounting plates and the lower arm as shown in FIG. 3 or can be incorporated in both arms as shown in FIG. 4, references 10′, 12′, 13′, 14′, 15′, 18′, 25′ and 25*a'* are included to indicate parts similar or relative to FIG. 1.

The result is by virtue of such a construction a more economical stay by reason of the elimination of the material as previously used for the respective mounting plate in my original stay. It is an easier stay both to manufacture and to install, allows for a slightly reduced window-frame cavity width if required, a longer and more solid stay, and room over the sash for cleaning.

What is claimed is:

1. A window stay for swingably mounting a window sash on a window frame, said stay comprising two mounting plates, two arms each of which is pivoted at one end to a said mounting plate, a single mounting plate to which the other end of each arm is pivotally mounted, at least one of the pivot joints at the ends of said arms being a wear resistant friction joint, said mounting plates having openings therethrough for securing said mounting plates to one of said frame and sash, and said single mounting plate having openings therethrough for securing said single mounting plate to the other of said frame and sash.

2. A window stay as claimed in claim 1, one of said mounting plates having a hole disposed at each side of its pivot for the reception of a fastening.

3. A window stay as claimed in claim 2, said mounting plates being vertically superposed, the lower said mounting plate having at least one slot extending lengthwise thereof for the reception of a fastening.

4. A window stay as claimed in claim 1, said arms being vertically superposed, the lower of said arm being thicker in cross section than the upper of said arms, said lower arm having a milled out portion about its pivot to the adjacent said mounting plate, said milled out portion being of a size and shape sufficient to allow said arm to turn about its pivot with said adjacent mounting plate, said milled out portion having a radiused end that receives a similarly radiused end of said adjacent mounting plate.

5. A window stay as claimed in claim 2, said mounting plates being vertically superposed and the lower said stub mounting plate having a milled out portion about its pivot with the associated said arm, said milled out portion receiving the adjacent end of said arm and permitting said arm to turn about said pivot.

6. A window stay as claimed in claim 1, said friction joint comprising a raised dimple of pressed metal, said dimple being semi-sheared to provide a counter sink for the tail of a pivot rivet and a raised surface for clearance of the associated said arm, a self-lubricating plastic washer having in its cross section an annular recessed area to receive said dimple, said washer being disposed between the adjacent said mounting plate and the adjacent said arm to prevent contact of the arm and mounting plate.

7. A window stay for swingably mounting a window sash on a window frame, said stay comprising two mounting plates, two arms one pivoted at one end to each said mounting plate, the other end of each arm being pivoted to a separate further mounting plate, at least one of the pivot joints at the ends of said arms being a wear resistant friction joint, said mounting plates having openings therethrough for securing said mounting plates to one of said sash and frame, and said further mounting plates having openings therethrough for securing said further mounting plates to the other of said sash and frame.

* * * * *